US005199809A

United States Patent [19]

Semerjian

[11] Patent Number: 5,199,809

[45] Date of Patent: Apr. 6, 1993

[54] SUSPENDING CLIP FOR HANGING BINDER

[76] Inventor: Joseph K. Semerjian, 1890 S. Locust St., Des Plaines, Ill. 60018

[21] Appl. No.: 876,648

[22] Filed: Apr. 30, 1992

[51] Int. Cl.[5] ..... B42F 3/00

[52] U.S. Cl. ..... 402/4; 312/184; 211/46

[58] Field of Search ..... 402/4, 38, 80 R; 312/184; 211/46, 113

[56] References Cited

U.S. PATENT DOCUMENTS 3,801,175 4/1974 Giulie ..... 312/184
3,857,492 12/1974 Michaelis et al. ..... 211/46
3,936,201 2/1976 Kenney et al. ..... 312/184 X
3,993,374 11/1976 Schudy et al. ..... 312/184
4,400,107 8/1983 Pitts ..... 312/184
4,708,509 11/1987 Brunett ..... 402/4

*Primary Examiner*—Timothy V. Eley
*Assistant Examiner*—Willmon Fridie, Jr.

[57] ABSTRACT

A ring binder having a binder mechanism with rivets secured to the mechanism. Resilient hanging clips ride on the rivets to permit extension of the clips for hanging the binder on a rack. Clips are retracted for normal use. Clips are removable from the rivets when deformed.

3 Claims, 4 Drawing Sheets

FIG. 2
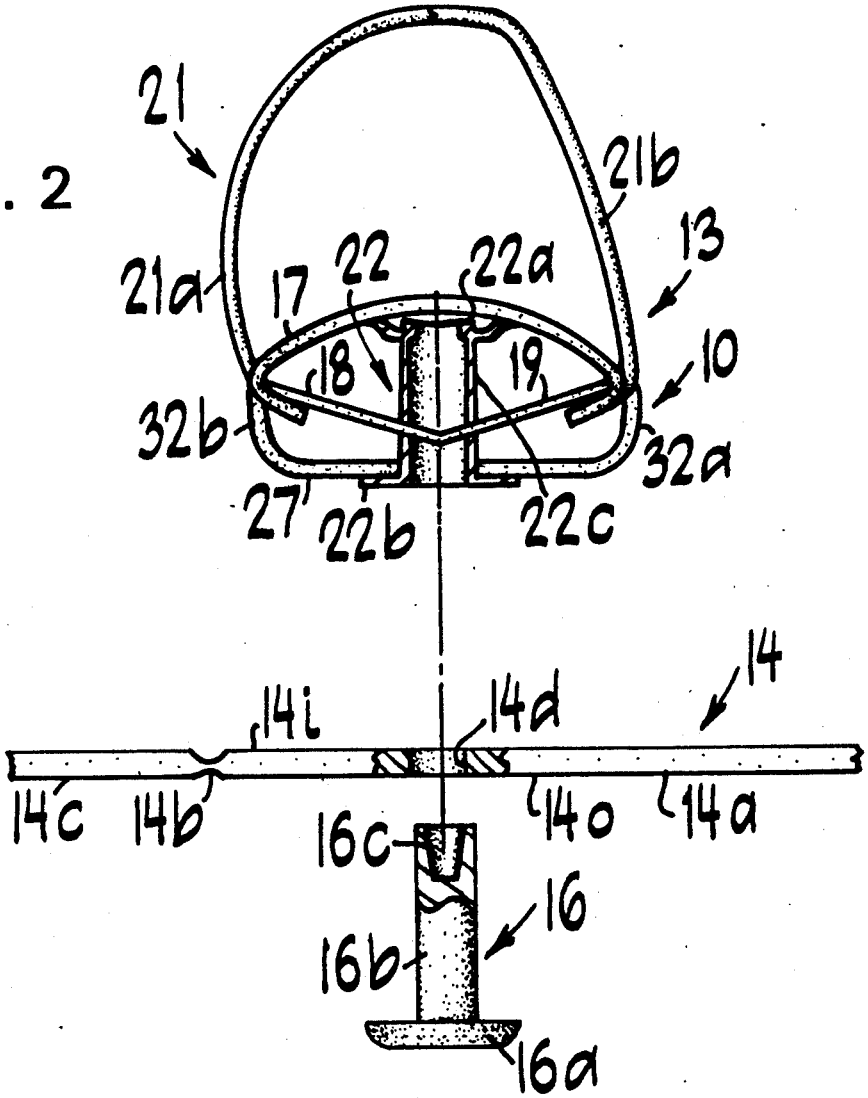
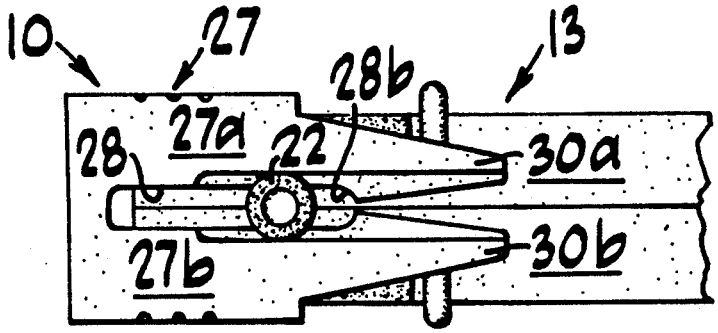
FIG. 3

FIG. 5
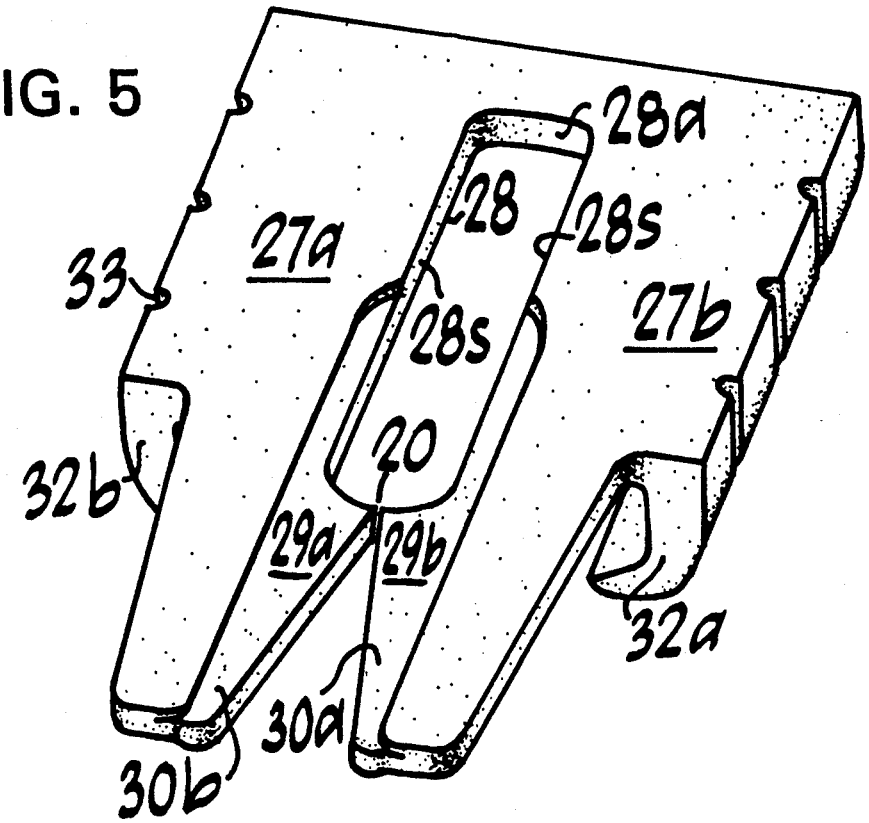
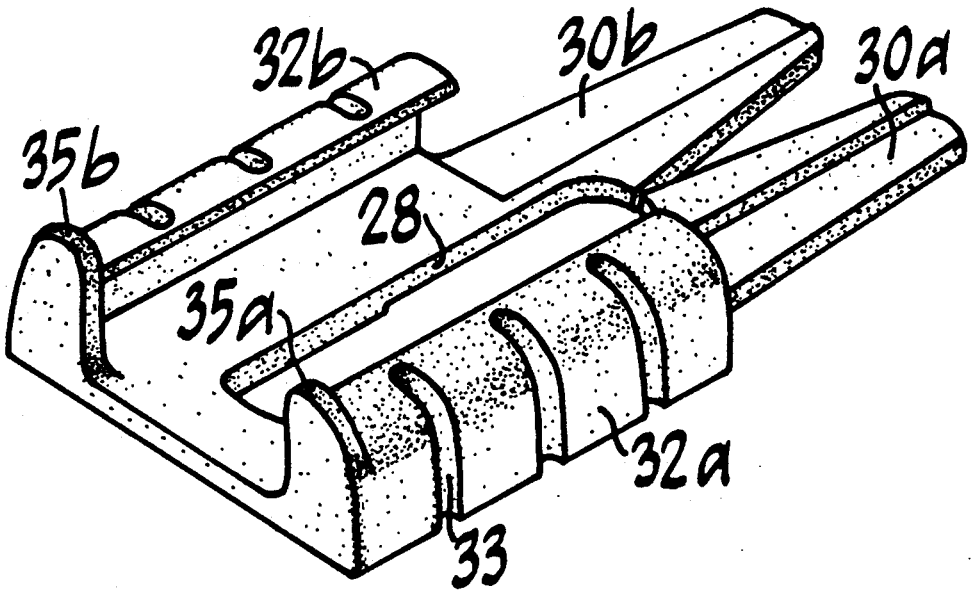
FIG. 6

SUSPENDING CLIP FOR HANGING BINDER

BACKGROUND OF THE INVENTION

Numerous extendable hook devices have been proposed for use in hanging binders (U.S. Pat. Nos. 3,957,321 and 4,323,318 and Canadian Patent No. 973,446). Translatable hanging clips with slots therein have also been proposed (U.S. Pat. No. 4,919,557). However, no fully satisfactory hanger arrangement for use with a ring binder assembly has yet been proposed.

SUMMARY OF THE INVENTION

Broadly, the present invention comprises a ring binder having resilient hanging clips mounted on housing eyelets which eyelets have clip bearing surfaces. The eyelets depend from the arcuate casing, and engage the binder cover when the binder is assembled.

It is a feature that the clips are slideable so that the clips can be extended for hanging. Each clip has a slot with a slit opening at one end so that the clip can be deformed to increase the size of the opening sufficiently to allow the eyelet to pass into or out of the clip slot.

BRIEF DESCRIPTION OF THE INVENTION

FIG. 2 is an exploded elevational view of a hanging binder of the present invention including the binder mechanism, cover and a suspending clip;

FIG. 3 is a partial bottom view of the binder mechanism with the clip slidable therein;

FIG. 4(*b*) is a partial elevational view of the binder mechanism with the clip retracted;

FIG. 5 is an enlarged perspective bottom view of the clip; and

FIG. 6 is an enlarged perspective top view of the clip.

DESCRIPTION OF THE PREFERRED EMBODIMENT

Figure 1:
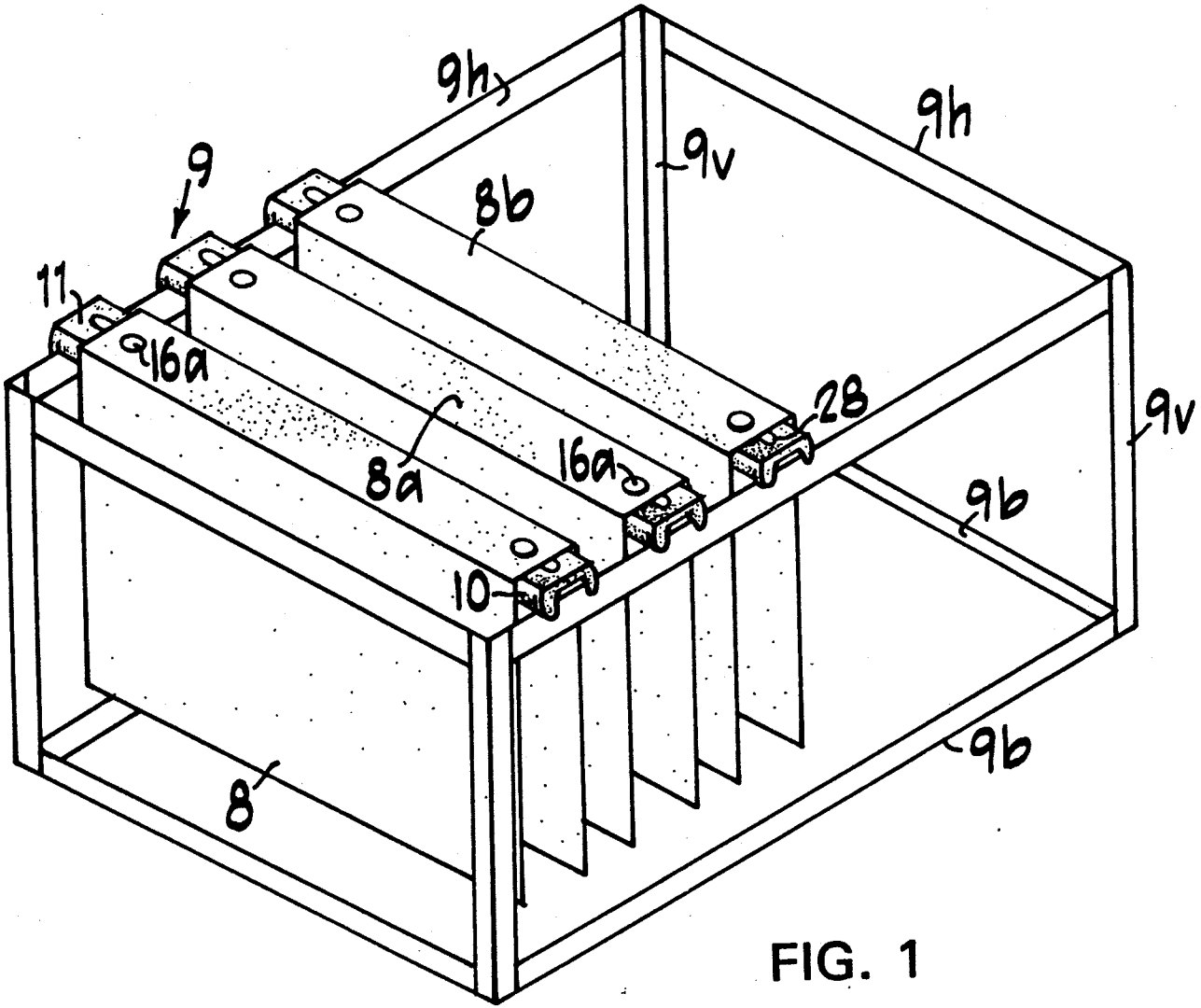
FIG. 1 is a perspective view of a series of binders hanging on a rack.

With respect to the figures, loose-leaf binders 8, 8*a*, 8*b*, etc. are hung on rack 9 using slidable suspension clips 10, 11 mounted at the ends of each of binders 8, 8*a*, 8*b*, etc. Rack 9 includes vertical members 9*v*, upper horizontal member 9*h*, and base members 9*b*.

Turning in particular to FIG. 2, each binder 8, 8*a*, 8*b* includes a binder mechanism 13, a cover 14 with an inside surface 14*i* and an outside surface 14, two suspension clips 10, 11, and two rivets 16 to secure each mechanism 13 and cover 14 together. Each mechanism 13 in turn comprises an elongated arched casing 17, two hinge plates 18, 19 and two or more rings 21 formed of ring halves 21*a*, 21*b*. Fastener housing eyelets 22 each have upper annular ends 22*a*, lower annular bearing ends 22*b* and round bearing stem portion 22*c*. The outside surface of stem 22*c* may be non-round provided it has curved or angled surfaces for enlarging slit opening 20 when force is applied. Upper eyelet ends 22*a* are secured by welding or otherwise to and depend from the underside of casing 17.

Binder cover 14 has base portion 14*a*, hinge 14*b*, top cover portion 14*c* and an aperture 14*d* in portion 14*a*. Rivets 16 which are housed in eyelets 22 include outside head 16*a*, stem 16*b* and deformable head 16*c*. Upon assembly and deformation of rivet head 16*c*, eyelets 22 and rivet 16 form a fastener assembly for holding together in spaced-apart relationship the cover 14 and arcuate casing 17. Clips 10, 11 are slidable mounted on head 22*b* and stem 22*c* between cover 14 and mechanism 13.

Turning to FIGS. 3, 5 and 6, each clip 10, 11 is made with plastic or other resilient material which when deformed restores itself to its original position and each clip 10, 11 includes outside bottom planar body portion 27 with a slot 28 extending vertically through body portion 27 which slot 28 includes outside end 28*a* and inside end 28*b*, which inside end 28*b* is split by slit opening 20. Opening 20 is normally narrower than the width (or diameter) of stem 22*c* but can be enlarged to allow stem 22*c* to pass therethrough. The length of slot 28 determines the length of clip travel which travel or reciprocation is limited by slot ends 28*a*, *b* engaging stem 22*c*. Bearing stem 22*c* bears on the sides 28*s* of slot 28 as clip 10 reciprocates. Clip portion 27 consists of two planar portion halves 27*a*, 27*b*. Each half 27*a*, 27*b* has recessed areas 29*a*, 29*b* respectively to accommodate heads 22*b* of eyelets 22. Each planar half 27*a*, 27*b* also includes sloping pointed inner prong portions 30*a*, 30*b* which can be deformed to spread apart to increase the size of slit opening 20 to allow bearing stem 22*c* to pass through for assembly and disassembly of clips 10, 11 on and off eyelet stem 22*c*. Clips 10, 11 also include curved wall portions 32*a*, 32*b* adjacent portion 27 which walls have ridges 33 therein to assist in gripping by the binder operator's hands. Each curved wall 32*a*, 32*b* also has rack-engaging lips 35*a*, 35*b* respectively.

Figure 4A:
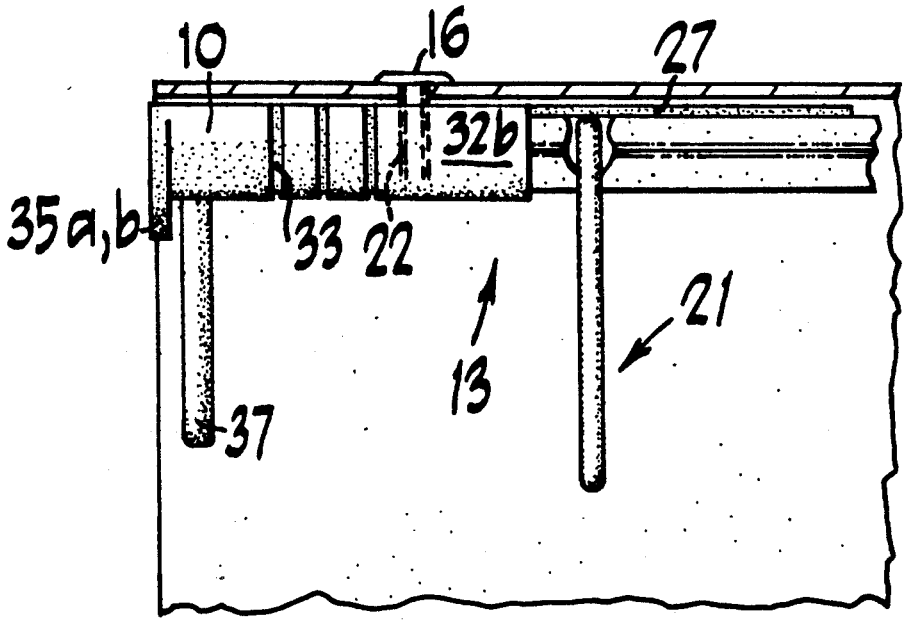
FIG. 4(*a*) is a partial elevational view of the binder mechanism with the suspension clip extended.
Figure 4B:
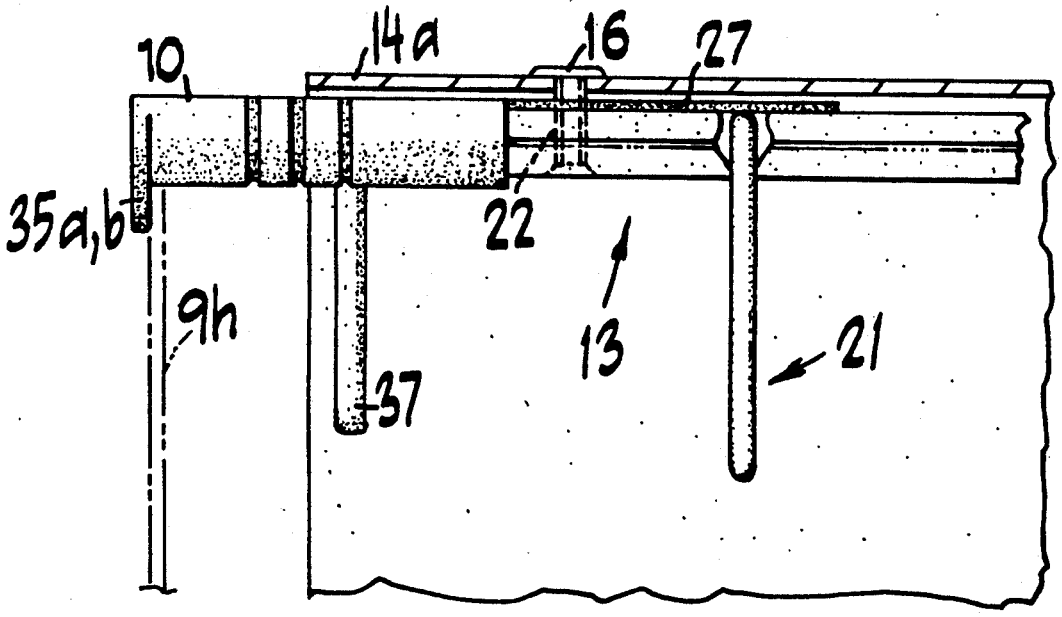

Finally, turning to FIG. 4*b*, slidable clip 10 is shown extended until eyelet 22 engages slot end 28*b* and in FIG. 4*a* clip 10 is shown retracted. Also shown in FIGS. 4*a*, 4*b*, is trigger 37 of binder mechanism 13.

I claim:

1. In a ring binder for hanging on a rack including an arched casing, a fastener eyelet housing having two ends and a stem with the first end secured to said casing and having a cover with an outside surface and an inside surface, the improvement comprising a) the fastener eyelet housing having its second end abutting the surface of the cover;

b) bearing means on the second end and the stem of said fastener housing;

c) a slidable clip suitably mounted on the bearing means of said fastener housing which clip in turn comprises i) a planar housing portion having two halves separated by a slot with two ends, one slot end having an opening therein, its slot configured to receive said fastening housing stem, said halves resiliently separable a sufficient distance to increase the opening at one end of the slot to allow the fastener housing stem to pass through the opening; and ii) lips adjacent the housing portion for engaging the rack whereby the clip can be placed on the binder for hanging on a rack and the clip can thereafter be removed from the binder.

2. The ring binder of claim 1 in which the clip includes sloping prongs so that such clip prongs can be pushed against the stem to increase the size of the opening at the end of the slot until the stem passes through the slot end opening.

3. The ring binder of claim 1 in which the stem has a curved surface and an end with an opening configured so that opening in the slot end is narrower than the stem width.

* * * * *